US005724781A

United States Patent [19]

Matthias et al.

[11] Patent Number: 5,724,781

[45] Date of Patent: Mar. 10, 1998

[54] METHOD FOR RAISING FOUNDATIONS

[76] Inventors: Billie Horace Matthias, 4301 Thicket Dr.; Sydney Alan Ardoin, 417 Clearfield Dr., both of Garland, Tex. 75043

[21] Appl. No.: 649,232

[22] Filed: May 17, 1996

[51] Int. Cl.[6] ..... E02D 35/00

[52] U.S. Cl. ..... 52/741.11; 52/125.1; 52/126.1

[58] Field of Search ..... 52/125.1, 126.1, 52/741.11, 745.2

[56] References Cited

U.S. PATENT DOCUMENTS

| | | | |
|---|---|---|---|
| 4,591,466 | 5/1986 | Murray et al. | 52/741.11 X |
| 4,800,700 | 1/1989 | May | 52/125.1 X |
| 5,205,673 | 4/1993 | Bolin et al. | 52/125.1 X |
| 5,492,437 | 2/1996 | Ortiz | 52/125.1 X |

*Primary Examiner*—Christopher Kent

*Attorney, Agent, or Firm*—John P. Halvonik

[57] ABSTRACT

A method for raising foundations of building structures is shown and described. The method uses a bracket assmebly having a tubular portion with a central channel and a lip that extends from the tubular portion. The lip is placed under the bottom surface of the foundation or slab and an assembly of pilings is driven through the channel until bedrock or other similar load bearing strata is encounterd. A hydraulic cylinder having a ram may be used to drive the sections of pipe that constitute the piling or pier. Once the bedrock is encountered by the pilings, a jacking saddle is attached to the bracket assembly in order to raise the foundation up a short distance in relation to the top of the piling. A gap is thus created between the slot in the bracket and the top of the upper most pipe. Into this gap is placed a series of one or more pins in order to support the foundation upon the top of the piling by means of the pins and prevent the house from settling but not prevent the house from rising.

1 Claim, 4 Drawing Sheets

METHOD FOR RAISING FOUNDATIONS

FIELD AND BACKGROUND OF THE INVENTION

The invention relates to the field of raising foundations and, in particular, to a method for raising foundations of houses and the like in relation to bedrock by use of hydraulic ram. The ram is supported upon a bracket having a channel in the bracket allowing a series of steel pipes to be driven through the bracket into the ground until bedrock or a load bearing strata has been reached. The hydraulic ram and driving assembly are removed. A jacking saddle is connected to the bracket and lifting of the saddle and foundation is preformed by means of a jacking operation. When the desired lift is achieved a pin or series of pins made from hot rolled square steel bars one inch square and 4 inches in length will be placed in the slot of the bracket, allowing the weight of the structure to be transfered to the pipes or pilings. The jacking saddle can now be removed. By: "foundation" it is meant the concrete slab or similar structure that exists at the bottom of the building in order to give it stability.

It is believed that by the use of such a system the house or building may be supported upon a series of pipes or pilings that is supported on bedrock or other secure load bearing strata adapted for such purpose. Such a system will permit the house to raise somewhat after the support pilings are already in place. Such a consideration may be important in areas where water may be likely to accumulate and raise up the house or in other situations where the house may raise by accident of nature, etc.

SUMMARY OF THE INVENTION

A method for raising foundations of building structures that utilizes a novel bracket and hydraulic ram system for driving pilings alongside the house in order to support it. The method uses a unique bracket assembly having a tubular portion and a lip that extends from the tubular portion. The lip is placed under the bottom surface of the foundation or slab extending approx 9 inches, and an assembly of pilings is driven through a channel that goes through the tubular portion. A hydraulic cylinder having a ram is used to drive the sections of the pipe that constitute the piling or pier. The tubular portion should be of large enough diameter in order to permit the series of pilings to be driven through the bracket and in the ground until a secure section of the strata of the earth, such as bedrock, is found. Once the bedrock is encountered by the pilings, a jacking saddle is attached to the bracket assembly in order to raise the foundation up in relation to the piling. A gap is thus created between a slot in the bracket and the top of the upper most of the pipes. Into this gap is placed a series of pins in order to support the foundation upon the pins and prevent the house from settling, but not prevent the house from rising.

It is among the objectives of the invention to allow the structure to continue to rise after the hydraulic jacking process has been completed in cases where the earth heaves because of a water leak, or for other reasons.

Another objective is to provide a method for raising the foundation of a building or other structure with a minimum of effort and provide a secure support that will not allow downward movement of the support assembly.

Another objective is to provide a method for raising the foundation of a building with a minimum of damage to the surrounding landscape.

Other objectives will be known to those skilled in the art once the invention is shown and described.

DESCRIPTION OF THE PREFERRED EMBODIMENT

Figure 6:
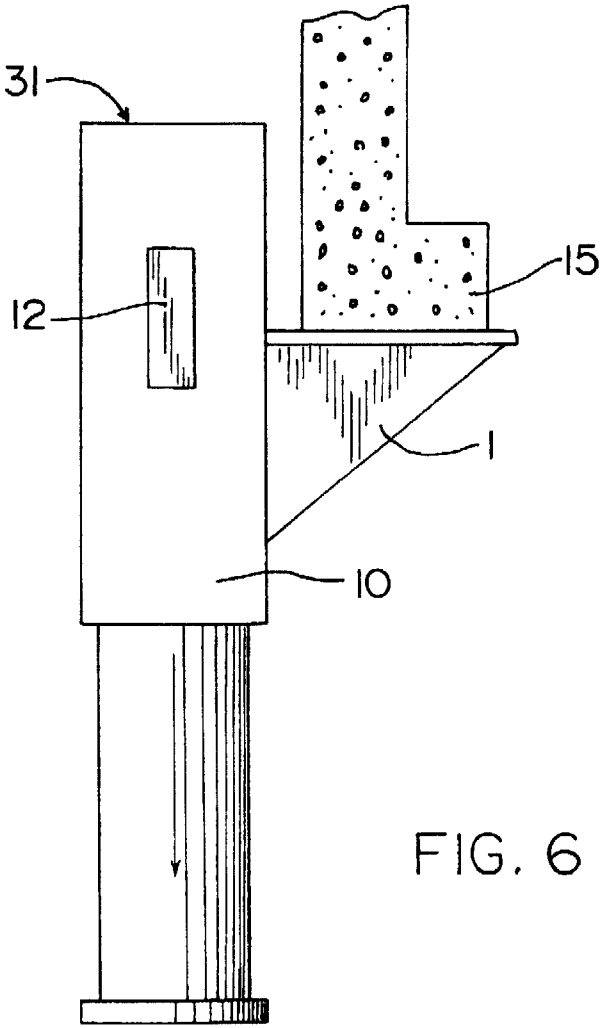
FIG. 6 Side view of bracket underneath foundation.

At the start of a pipe installation process, a hole should be dug beside the concrete beam 15 of the house or building and should be about 20"–30" in width and length. The depth of the hole should be about fifteen inches below the bottom beam of the house and the hole should extend back under the house for about ten inches. The dirt should be cleaned off the bottom of the slab in order to provide a clean surface for the engagement lip 1 of the bracket 2 to engage the slab.

In the preferred method, a hydraulically operated cylinder 8 or similar type of machine that provides a pushing motion is used to drive an assembly of pipes 18 or a piling into the earth alongside the foundation until hard strata, such as bedrock, is encountered. The cylinder has a ram 7 associated with it to supply the force against the pipe. This initial driving of the piling into the ground is in the direction of arrow 32 in FIG. 2. The series of pipes is used to support the foundation of a building by supporting the engaging lip 1 of the bracket 2 against the bottom of the slab or other part of the foundation, see FIG. 6.

Typically, a series of steel pipes (10 is the bottom most or first pipe and 18 are succeeding pipes) constituting an assembly or piling is driven into the ground until a relatively immobile strata of the earth is encountered, such as bedrock or similar material. Each succeeding section of pipe may be stacked upon the preceding pipe by feeding the next pipe through the channel 31 in the top of the bracket and onto the top of the stack. More than one bracket and piling may be used for all the different sides of the house.

After the bedrock has been reached during the initial downward driving of the pile (i.e. the predetermined resistance has been reached) that pipe at the top of the slot is marked, e.g. with soapstone. This last, or top piece, is removed from the bracket and cut down to a line so that the top of the pipe will now align with the top of the slot. This pipe is then placed back in the top of the pile-the top of it will be about flush with the top of the slot. The driving bracket (4 in FIG. 2) for the cylinder will be removed and the jacking saddle 11 is then attached to the bracket lifting wings 12, see FIG. 4.

Figure 4:
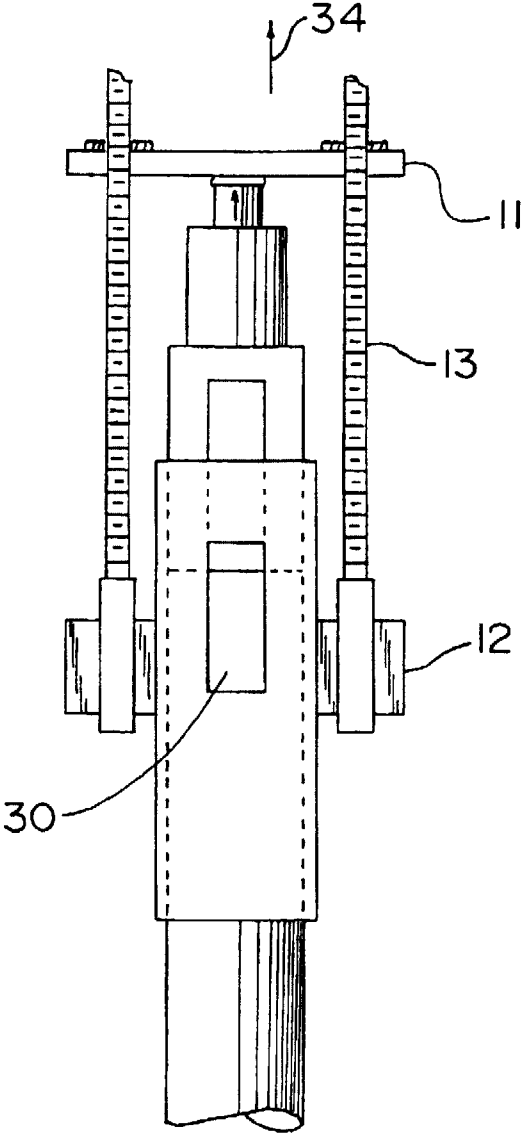
FIG. 4 Rear of bracket showing jacking saddle attached to lifting wings.

The jack and ram are now used to push in the opposite direction, or upward, in the direction of arrow 34 in FIG. 4. This will raise the bracket, and of course the foundation along with it, so that the slot will now be above the top of the topmost pipe instead of flush with it. When this is completed a series of pins should be placed in the slot 30 between the top of the top pipe and the top of the bracket slot. Probably about four or more metal pins may be used in the process. Finally, the pressure is removed on the jack and it, along with the jacking saddle, can be removed. The use of the pins will prevent the foundation from moving downward as the foundation is now resting on the bedrock through the pins. The arrangement will not prevent the house from moving upward only downward.

Figure 2:
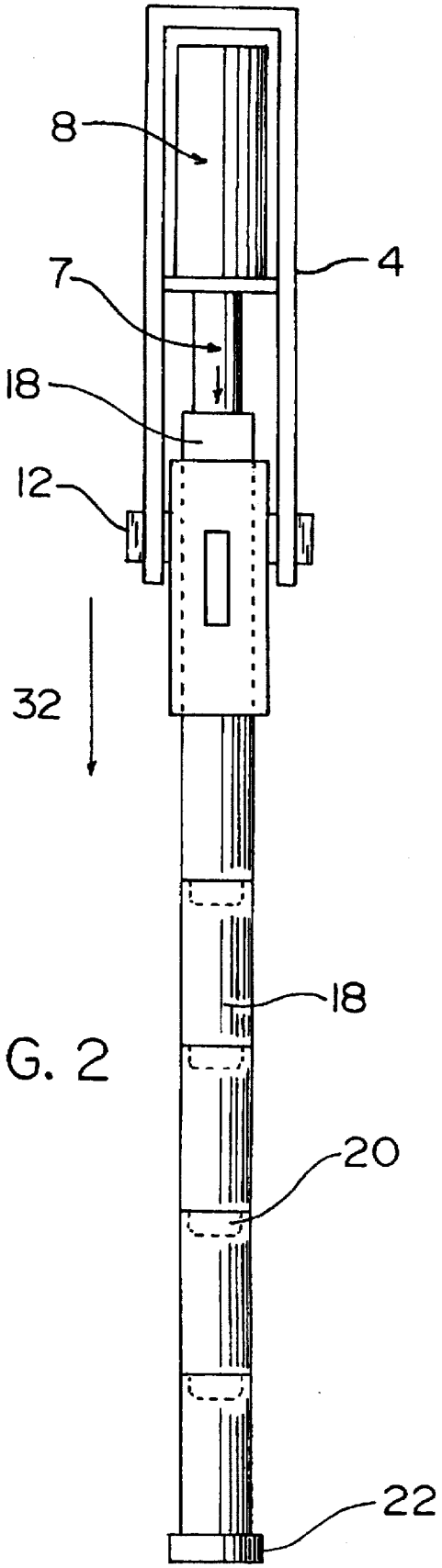
FIG. 2 Back view of hydraulic cylinder.
Figure 2A:
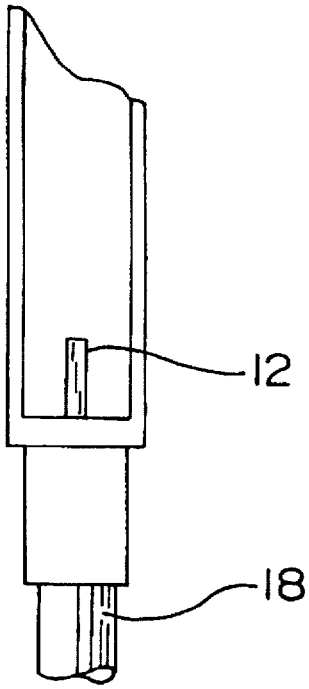
FIG. 2A detail of lifting wing.

The system of pilings may comprise a series of pipes connected to one another by means of slip collars mounted on the inside of each pipe and shown in FIG. 2. Such slip collars 20 or slip couplings may be welded or otherwise attached to the inside of each of the pipes 18 in the stack and so used to connect to the other pipe, either above or below it in the series, in order to prevent lateral movement of the pipes.

In addition to the slip collars, the stack of pipes should also have a friction collar 22 attached to the bottom most pipe 10 in the stack, i.e. the first pipe to be driven down into the earth by the hydraulic cylinder with a ram. The friction collar should extend for some small distance away from the pipe say: about ½' to ¾'.

Figure 3:
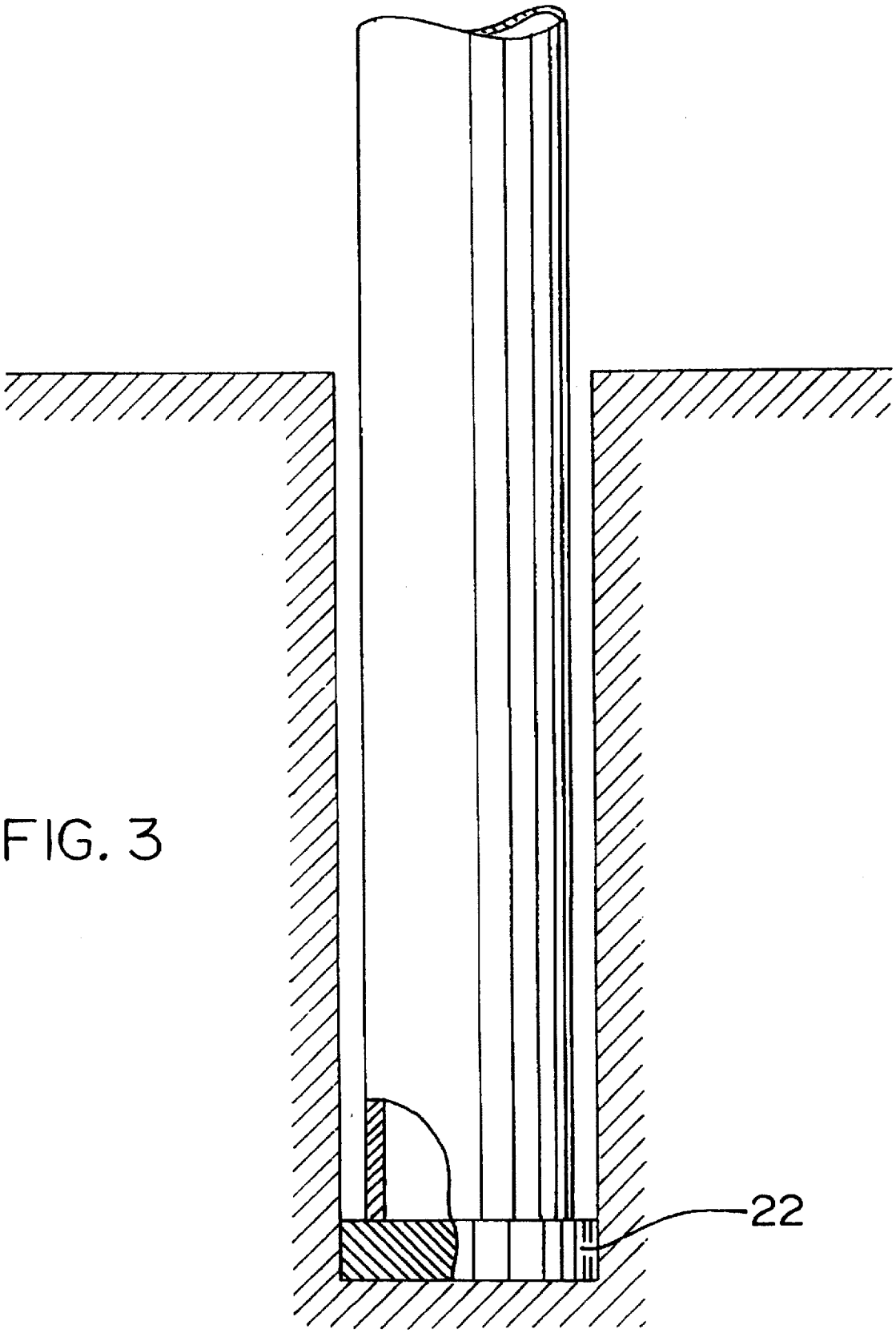
FIG. 3 View of friction collar and steel pier.
Figure 5:
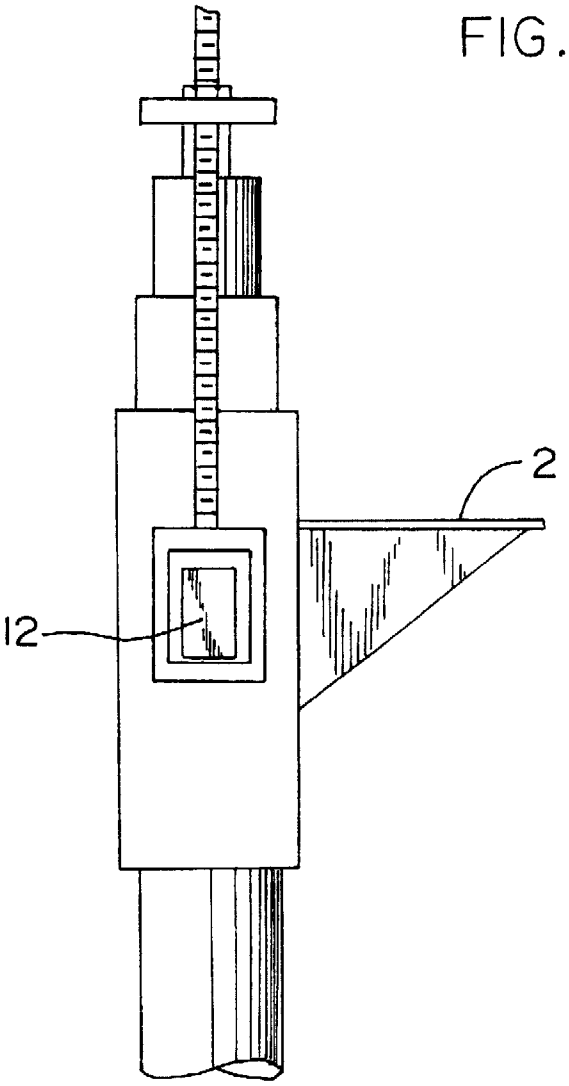
FIG. 5 Side view of jacking saddle attached to bracket lifting wings.

The use of such collar will clear away an area around the pipe as the stack is driven into the earth and so create a hole in the ground of a larger diameter than the pipe itself. Such a hole is shown in FIG. 3 and the use of such collar is believed to eliminate most of the side friction of the overall systems. As each successive pipe section is added to the piling, the next pipe to be added should be of the same diameter of the piling section preceding it and should be connected to the next pipe in the series by means of a slip collar.

Because the first pipe in the series will have the friction collar attached to it, this will make the effective diameter of the first pipe larger than the diameter of the inner bore of the bracket. Thus, the first pipe with the friction collar must necessarily be entered into the channel in the bracket by feeding the top of that pipe (that end without the friction collar) into the channel from the bottom of the bracket. Thus, the hole that is dug around the foundation needs to be deep enough in order to accommodate the first pipe and attached collar which will be inserted into the bottom side of the bracket.

Figure 1:
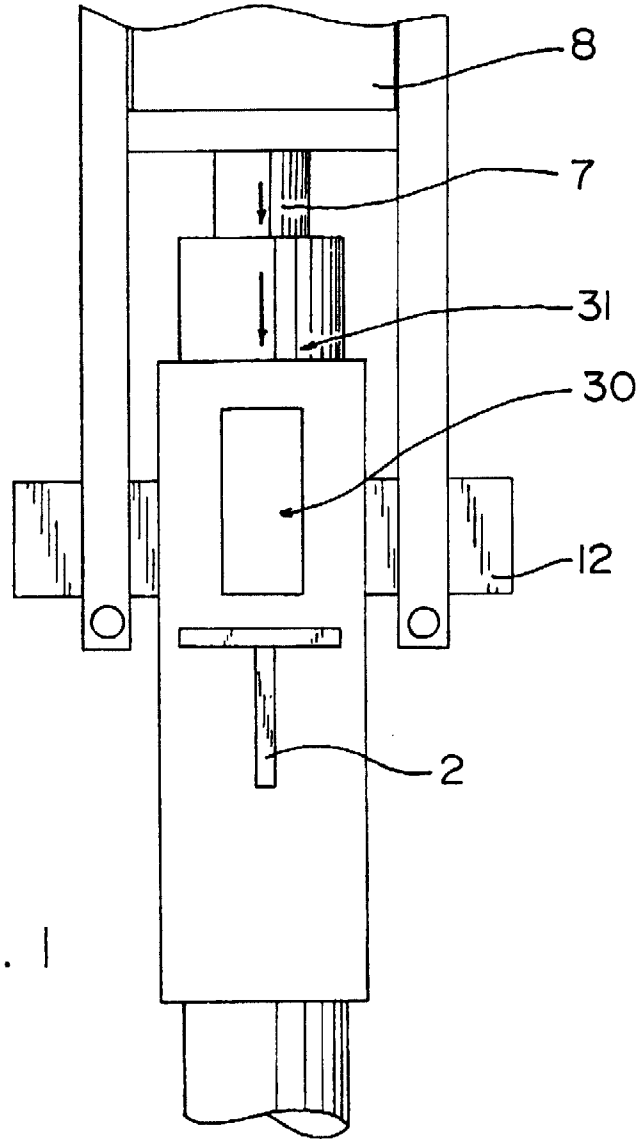
FIG. 1 Front view of bracket and slot.

The bracket 1 in FIGS. 6 & 1 comprises a tubular portion having an internal bore or channel of large enough diameter in order that the series of pipes may be driven through this channel. There is a lip 5 FIG. 2 that extends from the tubular section and at a direction perpendicular to the axis of the channel. The lip is seen to be of "T" shape when seen from the front as seen in FIG. 1. The lip should be large enough to extend underneath the foundation or the slab of the structure. There is at least one slot 30 on the side opposite the lip and there is another similar slot on the same side as the lip. In any event, the slot should be just above the lip as seen in FIG. 1. It is preferred that the slot be about five inches 5" in length. The wings 12 of the bracket should be at right angles to the lip and should extend at either side of the bracket.

The use of the bracket and pin in this system allows the foundation to be supported without disturbing a large amount of the landscape.

We claim:

1. A method of raising and supporting the undersurface of a foundation or slab of a building, the method comprising the steps of:

digging a hole alongside the foundation and for a short distance underneath the foundation;

placing a bracket within said hole and alongside the slab or the foundation, said bracket comprising a tubular section having a channel running through said bracket so as to define a central axis parallel to said channel, said bracket having an engagement plate in connection with a portion of said tubular section and extending from said tubular section in a direction perpendicular to said central axis, said bracket having a slot having an axis of direction running through said tubular section and perpendicular to said central axis, said slot further extending in a direction parallel to said central axis; said slot being at a point on said tubular section opposite said engaging plate;

placing said engaging plate beneath the undersurface of the slab;

directing a piling assembly through said central axis by feeding a series of pipes through said channel, said piling assembly including a bottom most pipe having a friction collar in connection so as to create a hole that is of greater diameter than a diameter of said series of pipes when said assembly is forced downward, and having a topmost pipe at the top of said series of pipes;

driving said piling assembly through said central axis until a predetermined resistance is encountered;

attaching a jacking assembly to said bracket and said topmost pipe;

lifting said foundation by means of said jacking assembly for a distance until said foundation has reached a predetermined level so as to create a gap between said slot in said bracket and said topmost of said series of pipes;

placing at least one pin through said slot so to rest upon said topmost pipe and thus support said building upon said series of pipes.

* * * * *